US005090289A

United States Patent [19]

Holcomb

[11] Patent Number: 5,090,289

[45] Date of Patent: Feb. 25, 1992

[54] DOUBLE-STRIKE PERCUSSION INSTRUMENT BEATER APPARATUS

[76] Inventor: Matthew L. Holcomb, 1040 ½ E. 4th St., Mishawaka, Ind. 46544

[21] Appl. No.: 588,706

[22] Filed: Sep. 27, 1990

[51] Int. Cl.[5] ..... G10D 13/02

[52] U.S. Cl. ..... 84/422.1

[58] Field of Search ..... 84/422.1, 422.2, 422.3

[56] References Cited

U.S. PATENT DOCUMENTS

| | | | |
|---|---|---|---|
| 774,539 | 11/1904 | Stanton | 84/422.2 |
| 1,016,510 | 2/1912 | Meyer | 84/422.2 |
| 1,042,919 | 10/1912 | Hughes | 84/422.2 |
| 1,092,276 | 4/1914 | Ludwig | 84/422.2 |
| 1,508,390 | 9/1924 | Gladstone, et al. | 84/422.2 |
| 2,484,302 | 10/1949 | Laverents | 84/422.2 |
| 2,484,936 | 10/1949 | Dezso | 84/422.1 |
| 2,787,930 | 4/1957 | Della-Porta | 84/422.1 |
| 3,618,441 | 11/1971 | Fearns | 84/422.1 |
| 3,677,128 | 7/1972 | Simpson | 84/422.1 |
| 3,968,718 | 7/1976 | Carver | 84/422.1 |
| 4,134,325 | 1/1979 | Loftus | 84/422.1 |
| 4,188,853 | 2/1980 | Bills | 84/422.1 |

*Primary Examiner*—L. T. Hix
*Assistant Examiner*—Howard B. Blankenship
*Attorney, Agent, or Firm*—Barnes & Thornburg

[57] ABSTRACT

A double action pedal-activated beater assembly is provided for a percussion instrument. The beater mechanism provides multiple beats of the percussion instrument for each completed cycle of a foot operated pedal. One beat is provided by rotational movement of the rotatable beater assembly through a linkage between the beater assembly and one end of the foot operated pedal. Another beat is provided by the interaction of a cam surface located on the foot operated pedal with a cam contacting surface on the rotatable beater assembly. This construction provides a durable and simple beater mechanism which yields two beater strokes per cycle of a foot pedal, each at any desired power level.

9 Claims, 5 Drawing Sheets

DOUBLE-STRIKE PERCUSSION INSTRUMENT BEATER APPARATUS

BACKGROUND AND SUMMARY OF THE INVENTION

The present invention relates generally to a beater apparatus and more particularly to a double-strike percussion instrument beater apparatus adapted to strike a surface twice in response to each cycle of a foot operated pedal.

Typical prior art foot-activated instrument striking mechanisms provide one strike for each complete cycle of a foot pedal. Accordingly, for a musician to effect a particular frequency of, for example, drum beats, he must cycle the drum pedal at an equal frequency. The frequency of drum beats obtainable is thus limited by the speed with which the musician can cycle the foot pedal. The present invention comprises a mechanism which effectively overcomes this limitation by permitting the musician to obtain multiple beats for each cycle of the foot pedal.

In the prior art, several foot-actuated drum beaters which provide multiple beats per cycle of a foot pedal have been proposed. U.S. Pat. No. 3,618,441 to Fearns discloses a double acting base drum pedal mechanism wherein a beater is mounted on a horizontal shaft with an arm extending downwardly from the shaft and offset from the rotary axis thereof. A pedal having a centralized pivot point is mounted adjacent the beater shaft and a flexible strip connects the downwardly extending arm of the shaft to the toe of the pedal so that rocking of the pedal in either direction will rotate the shaft and cause the beater to strike a drum head. Positive control over the beater shaft movement is possible only in the direction of the drum head and a spring must be used to return the beater shaft to a neutral position. Furthermore, the use of a central pivot point for the pedal results in an awkward and uncomfortable foot position for actuation of the beater mechanism.

U.S. Pat. No. 4,188,853 to Bills discloses a double acting drum beater device having a beater adapted to strike an adjacent drum head once for each downward movement of a foot operated pedal and then a second time for each upward movement of the Pedal. The mechanism provides for positive control over the movement of the beater shaft in the direction of the drum head and in the reverse direction. The drum beater is mounted on a rotatable horizontal shaft and the toe of the foot pedal is connected to the shaft through a linkage. The linkage is designed such that the shaft will rotate and cause the beater to strike a drum head once during downward movement of the toe Portion of the pedal and once during upward motion of the toe portion of the pedal. A toe clip is provided for enabling the user to cause the drum beater to strike the drum head with the desired force on the upswing of the toe portion of the pedal. This device necessitates the use of an intricate multiple linkage for effecting both beats during the cycle of the foot pedal. Furthermore, the use of a toe clip is necessitated for delivering a second beat having the desired power level.

It is therefore an object of the present invention to provide an improved device for causing multiple beats of a percussion instrument per cycle of a foot pedal.

Another object of the present invention is to provide an improved device which does not require the use of intricate or fragile linkages between a foot pedal and a rotary shaft supporting a beater.

It is yet another object to provide a device yielding two beats of an instrument for each cycle of a foot pedal, each beat effected with a controllable force.

Still yet another object of the present invention is to provide an improved device for effecting two beats of a surface per cycle of a foot pedal, wherein the user's foot may be comfortably supported in an operable position without the need for clips or straps.

These and other objects of the present invention are attained in the provision of a device which delivers two beats of a Percussion instrument per one cycle of a foot pedal by employing a simple linkage between the pedal and the beater for one beat during the cycle and which employs a simple cam mechanism for delivering another beat during the cycle. More specifically, the subject device comprises pedal means pivotally mounted on a base, and a beater shaft pivotally mounted independently of the Pedal near one end of the pedal. The beater shaft may have an end structure in the form of a mallet or head for the purpose of effecting a desirable beat sound.

For the purpose of providing a first strike of the drum, a linkage is employed to connect one end of the pedal with an arm extension which is offset from the axis of the rotatable shaft. The linkage is designed such that it allows positive drive of the rotatable shaft when the pedal is pivoted in one direction and non-positive drive when the pedal is rotated in a second direction, opposite the first direction. For the purpose of providing a second strike of the drum, cam means are mounted on the pedal at a point adjacent the end exhibiting the linkage. Cam contacting means are offset from the axis of the rotatable shaft and alignable with the cam means located on the pedal. The rotatable shaft is positioned such that downward motion of the end of the pedal containing linkage caused by rotation of the pedal about its axis of rotation will in turn cause the beater shaft, connected to the pedal through the linkage, to rotate about the axis of the horizontal shaft and strike a surface positioned adjacent the assembly. Subsequently, rotation of the pedal about its rotational axis in a manner which causes the end of the pedal containing the linkage to move upward, causes the cam means mounted on the pedal to abruptly contact the cam contacting means associated with the beater shaft. This contact in turn causes the beater shaft to be swiftly rotated about the horizontal shaft, thereby causing the beater shaft to again strike the adjacent surface. Therefore, rotation of the pedal in one rotational direction followed by rotation of the pedal in the opposite rotational direction, i.e., one complete cycle of the foot pedal causes the beater shaft to strike an adjacent percussion instrument surface twice in rapid succession.

Further objects, features and advantages of the present invention will become apparent from the following description when considered in conjunction with the accompanying drawings.

DETAILED DESCRIPTION OF THE DRAWINGS

Figure 1:
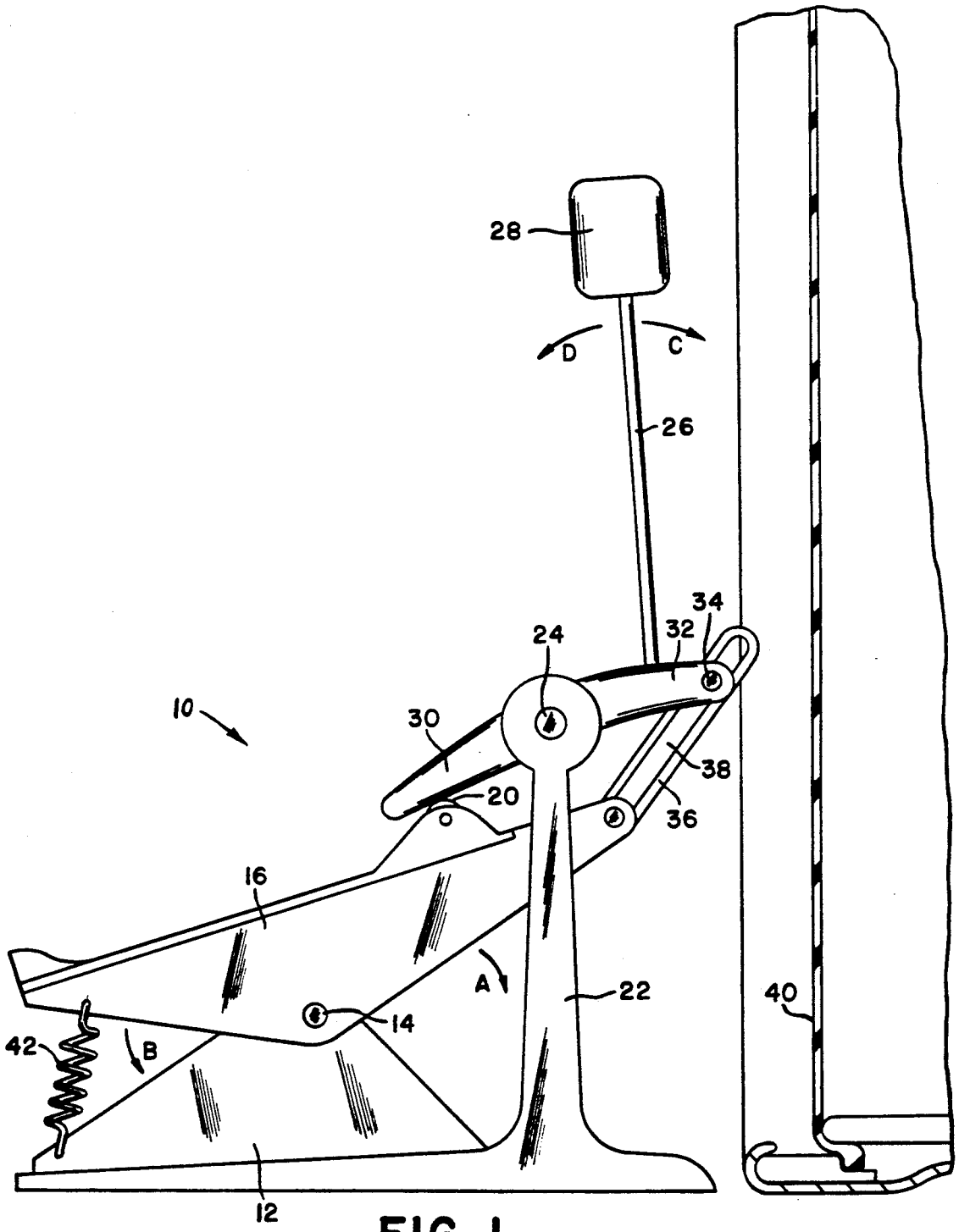
FIG. 1 is a side view of a preferred embodiment of a double-strike percussion instrument beater apparatus with the drum pedal and beater assembly in its neutral position.

Referring now to the drawings, in which like referenced characters indicate corresponding elements throughout the several views, attention is first directed to FIGS. 1 through 5 which illustrate a preferred embodiment of a double-strike percussion instrument beater apparatus, indicated generally by the character 10. Double-strike percussion instrument beater apparatus 10 includes base 12 which supports first horizontally disposed shaft 14 onto which pedal 16 is rotatably mounted. Pedal 16 includes second horizontally disposed shaft 18 and at least one, and preferably two cam surfaces 20. A pair of support members 22 pivotally engage third horizontally disposed shaft 24 onto which beater shaft 26 is mounted. Base 12 and support members 22 may be separate structures or integrally formed.

Beater shaft 26 has drum mallet 28 attached thereto. Cam contacting surfaces 30 extend radially from beater shaft 26. Also extending radially from beater shaft 26 and in a direction opposite that of cam contacting surfaces 30 is arm extension 32. Arm extension 32 includes fourth horizontally disposed shaft 34.

Linkage 36 provides a connection between second horizontally disposed shaft 18 on the end of pedal 16 and fourth horizontally disposed shaft 34 on arm extension 32. Linkage 36 is designed such that rotation of pedal 16 in the direction designated by arrow A will effect positive drive of beater shaft 26 in the rotational direction designated by arrow C. In contrast, rotation of pedal 16 in the direction designated by arrow B will not effect positive drive of beater shaft 26 due to the presence of slot 38. Slot 38 thus permits relative translational movement of second horizontally disposed shaft 18 and fourth horizontally disposed shaft 34. Base 12 and support members 22 are oriented such that cam contacting surfaces 30 and cam surfaces 20 integral with pedal 16 are aligned in the same vertical plane.

Figure 2:
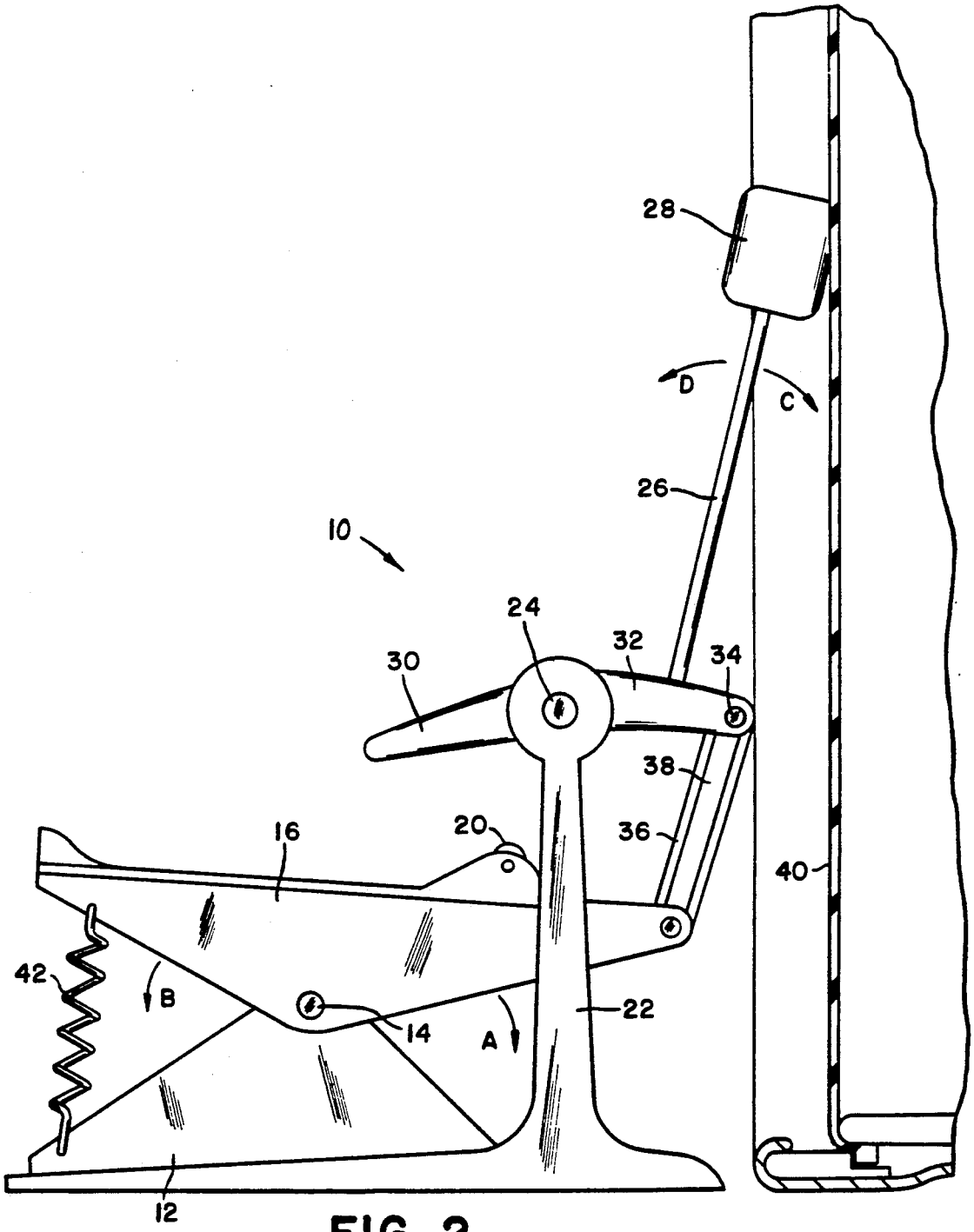
FIG. 2 is a side view of the double-strike percussion instrument beater apparatus shown in FIG. 1 with the linkage employed to drive the beater assembly.

In operation, a user places his foot on pedal 16 and applies a first force such that pedal 16 rotates in the direction of arrow A. This force upon rotation of pedal 16 about first horizontally disposed shaft 14 in the direction of arrow A is transmitted to the beater shaft 26 through linkage 36 and second horizontally disposed shaft 18 and fourth horizontally disposed shaft 34. The force transmitted through linkage 36 then causes beater shaft 26 to rotate about second horizontally disposed shaft 24 in the direction of arrow C. As seen in FIG. 2, the rotation of beater shaft 26 is abruptly stopped upon contact of drum mallet 28 with drum surface 40 resulting in the generation of the first desired drum beat of the foot pedal cycle. The user then immediately applies a second force to pedal 16 so as to cause pedal 16 to rotate about first horizontally disposed shaft 14 in the direction of arrow B.

Rotation of pedal 16 in direction of arrow B allows the beater assembly, i.e., beater shaft 26 and drum mallet 28, to rotate in the direction of arrow D thus causing displacement of linkage 36 in an upward direction. Rotation of beater shaft 26 in the direction of arrow D continues until cam contacting surfaces 30, connected to beater shaft 26, contact cam surfaces 20 of pedal 16.

Figure 3:
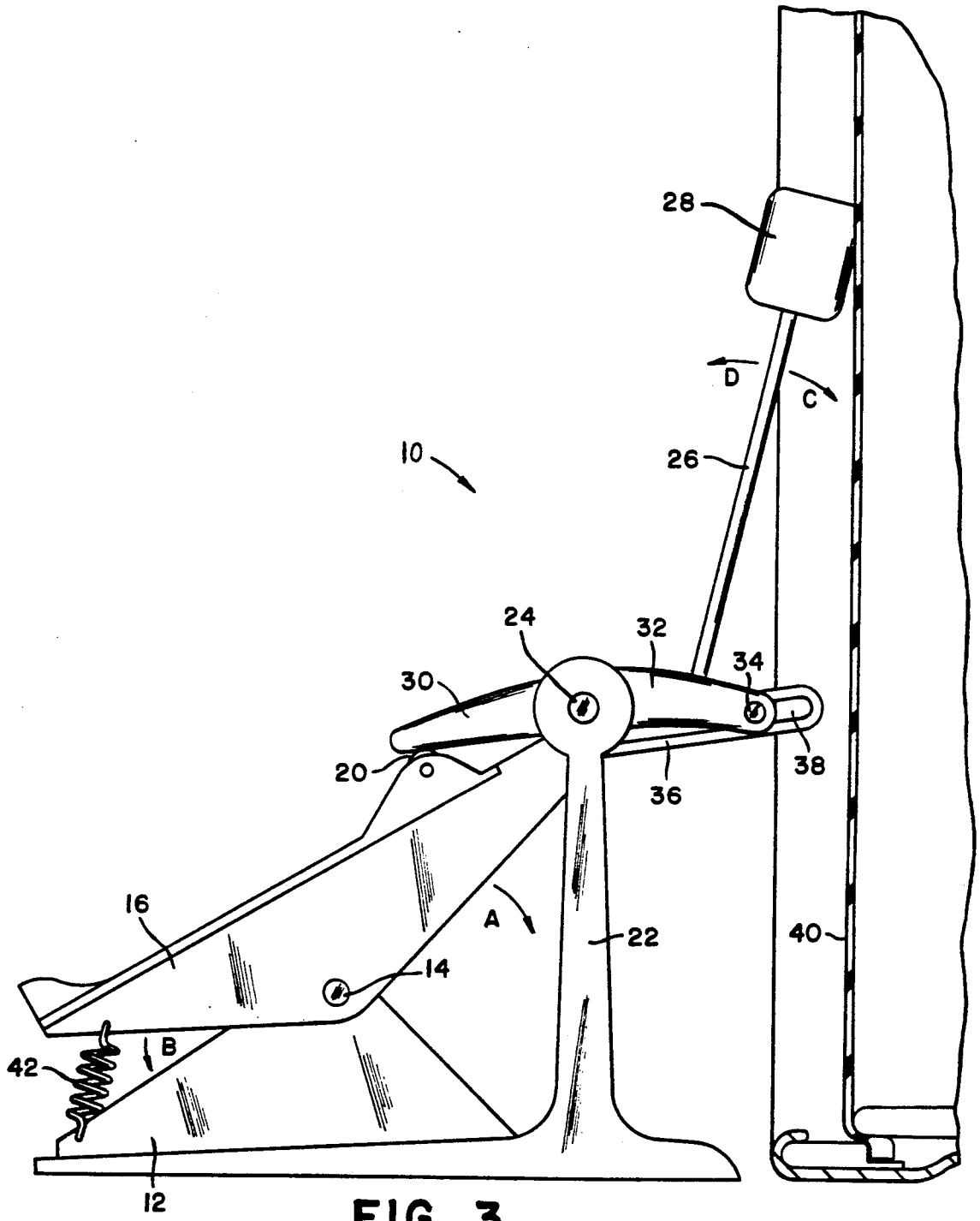
FIG. 3 is a side view of the double-strike percussion instrument beater apparatus shown in FIG. 1 with the cam means employed to drive the beater assembly.
Figure 4:
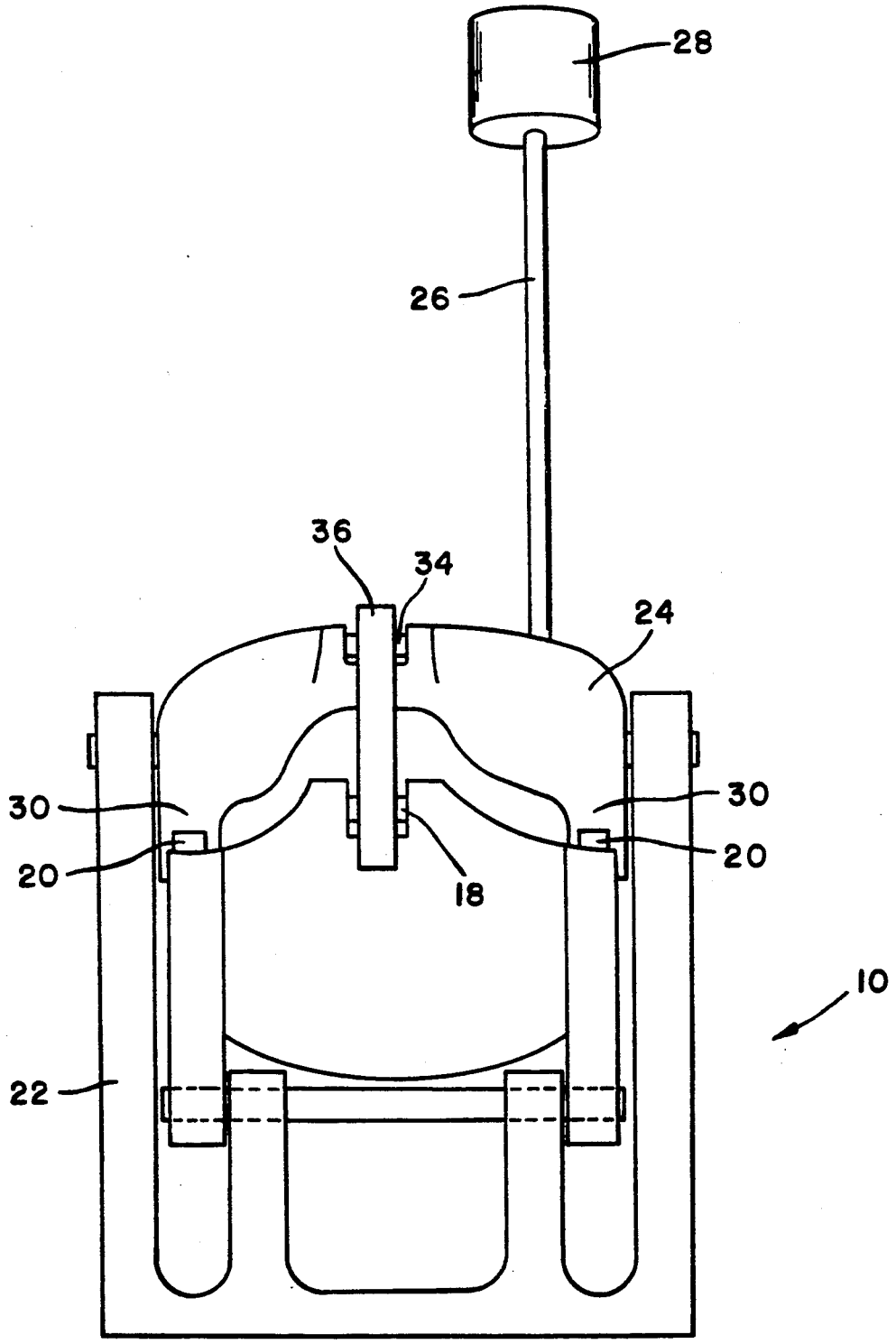
FIG. 4 is a front view of the double-strike percussion instrument beater apparatus shown in FIG. 2 with the drum pedal and beater assembly in its neutral position.
Figure 5:
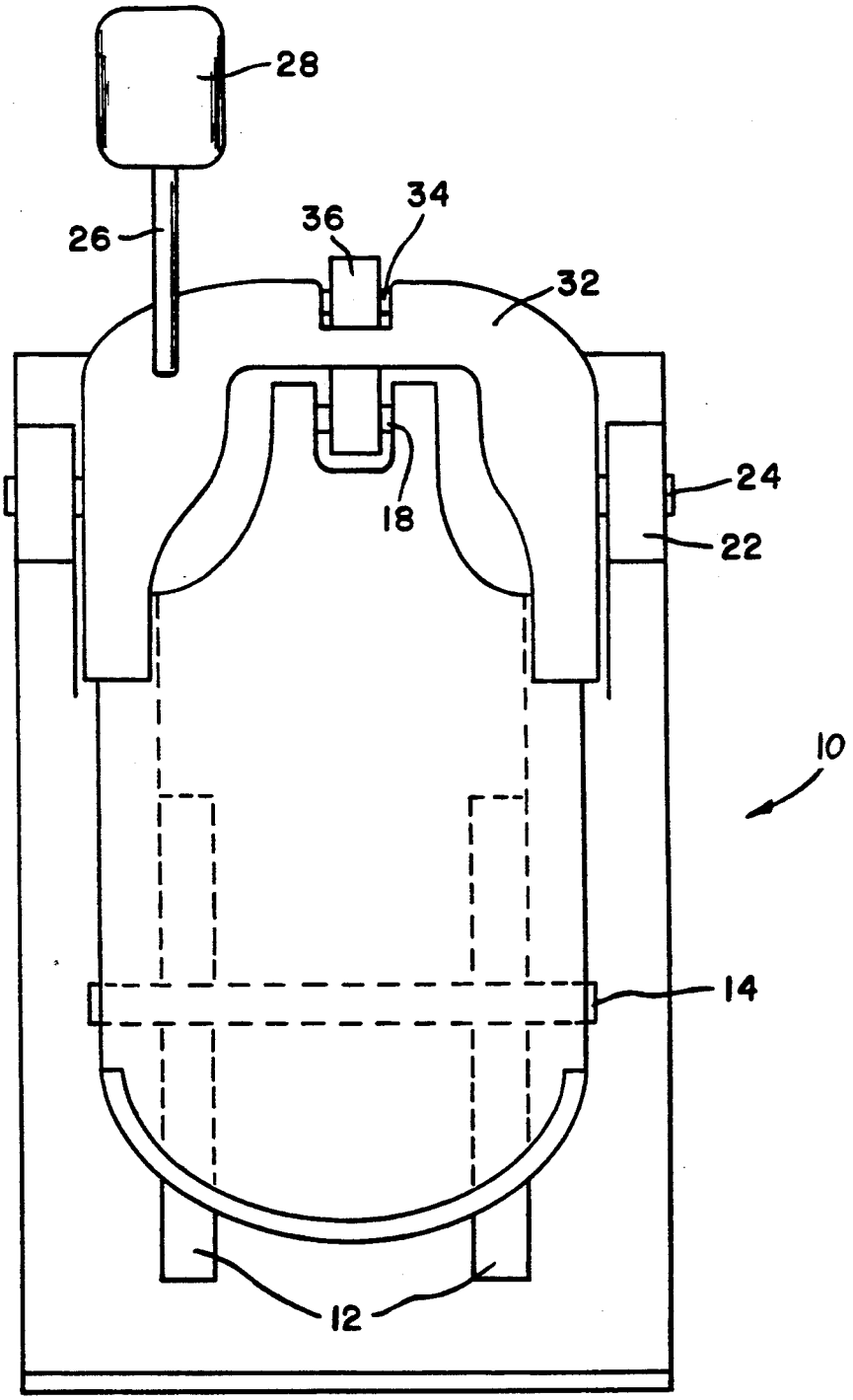
FIG. 5 is a top view of the double-strike percussion instrument beater apparatus shown in FIG. 1 with the drum pedal and beater assembly in its neutral position.

A second force is then transmitted to cam contacting surfaces 30 through the motion of cam surfaces 20, integral with pedal 16, thereby causing rotation of beater shaft 26 about third horizontally disposed shaft 24 in the direction of arrow C. At this point in the cycle, slot 38 in linkage 36 permits relative translational movement of second horizontally disposed shaft 18 and fourth horizontally disposed shaft 34, thereby permitting rotation of beater shaft 26 in the direction of arrow C notwithstanding the fact that the end of pedal 16 exhibiting linkage 36 is in an upward orientation. As seen in FIG. 3, the rotational motion of beater shaft 26 is abruptly stopped when drum mallet 28 contacts drum surface 40 thus generating the second desired beat of the foot pedal cycle.

The force of each beat of the foot cycle is readily controlled by the use by controlling the force with which he rotates the foot pedal. One beat may be emphasized or both may be effected with approximately equal force.

The force applied to the pedal for the purpose of causing rotation of the pedal about first horizontally disposed shaft 14 in the direction of arrow B need not be supplied by the foot of the user. This force could be supplied by a biasing means such as, for example, coil spring 42 connecting base 12 and pedal 16. Alternatively, the force necessary to cause rotation of pedal 16 about first horizontally disposed shaft 14 in the direction of arrow A may be supplied by repositioning biasing means connecting base 12 and pedal 16. In each of these arrangements, the user supplies the force necessary to cause rotation of pedal 16 in either the direction of arrow A or in the direction of arrow B thereby effecting a first beat, while the biasing means provides the force necessary to rotate the pedal in the opposite direction, thereby effecting a second beat.

It is readily apparent from the above description that the beater device of the present invention provides two beats of a percussion instrument per single cycle of a foot pedal by means of a durable mechanism having a minimum number of movable parts. The subject device does not require fragile or intricate linkages, but rather provides efficient operation through a simple linkage and cam arrangement. Moreover, two beats at any desired power level are provided per cycle of a foot pedal without the need for foot straps or toe clips. The beater of the present invention is readily adapted to a variety of percussion instruments such as drum heads or cymbals.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A double action beater apparatus for striking a surface of a percussion instrument, comprising:

a support means;

a beater means rotatably mounted on said support means for striking said surface of said percussion instrument;

said beater means having an offset arm means and a cam contacting means connected thereto;

a pedal means pivotally mounted on said support means;

said pedal means having cam means associated therewith, said cam means engaging said cam contacting means and causing said beater means to rotate into a surface striking position when said pedal means is pivoted in a first pivotal direction;

a linkage means for connecting said pedal means to said offset arm means; and said linkage means causing said beater means to rotate into said surface striking position when said pedal means is rotated in a second pivotal direction opposite to said first pivotal direction.

2. An apparatus according to claim 1, wherein said surface is a drum head.

3. An apparatus according to claim 1, wherein said surface is a cymbal surface.

4. An apparatus according to claim 1, wherein said pedal means is spring biased in one pivotal direction.

5. An apparatus according to claim 4, wherein said pedal means is spring biased in said first pivotal direction.

6. An apparatus according to claim 4, wherein said pedal means is spring biased in said second pivotal direction.

7. An apparatus according to claim 1, wherein said linkage means effects positive drive of said beater means only when said pedal means is pivoted in said second pivotal direction.

8. An apparatus according to claim 1, wherein said linkage means includes a longitudinal slot and said pedal means includes a pin engaged in said longitudinal slot.

9. An apparatus according to claim 1, wherein said beater means has drum beating head means disposed at one end thereof.

* * * * *